US007713422B2

(12) United States Patent
Kitagawa et al.

(10) Patent No.: US 7,713,422 B2
(45) Date of Patent: May 11, 2010

(54) BLACK LIQUOR TREATMENT METHOD

(75) Inventors: Sadao Kitagawa, Yokohama (JP); Akira Ako, Yokosuka (JP)

(73) Assignee: K.I. System Co., Ltd., Yokohama-shi, Kanagawa (JP)

( * ) Notice: Subject to any disclaimer, the term of this patent is extended or adjusted under 35 U.S.C. 154(b) by 605 days.

(21) Appl. No.: 11/629,484

(22) PCT Filed: Sep. 7, 2005

(86) PCT No.: PCT/IB2005/002662

§ 371 (c)(1),
(2), (4) Date: Dec. 14, 2006

(87) PCT Pub. No.: WO2006/038072

PCT Pub. Date: Apr. 13, 2006

(65) Prior Publication Data

US 2007/0227979 A1 Oct. 4, 2007

(30) Foreign Application Priority Data

Sep. 7, 2004 (JP) ..... 2004-260103

(51) Int. Cl.
*C02F 1/54* (2006.01)
*C02F 1/78* (2006.01)
*C02F 103/28* (2006.01)

(52) U.S. Cl. ..... 210/666; 162/29; 162/30.11; 210/694; 210/705; 210/712; 210/721; 210/725; 210/748.04; 210/752; 210/760; 210/928

(58) Field of Classification Search ..... 210/721
See application file for complete search history.

(56) References Cited

U.S. PATENT DOCUMENTS

| | | | | | |
|---|---|---|---|---|---|
| 4,008,161 | A * | 2/1977 | Wong et al. | ..... | 210/666 |
| 4,076,617 | A * | 2/1978 | Bybel et al. | ..... | 210/748 |
| 4,159,223 | A * | 6/1979 | Baierl | ..... | 162/14 |
| 4,173,532 | A * | 11/1979 | Keoteklian | ..... | 210/631 |
| 4,470,876 | A | 9/1984 | Beaupré et al. | | |
| 4,724,045 | A * | 2/1988 | Ackel | ..... | 162/29 |
| 5,635,024 | A * | 6/1997 | Shall | ..... | 162/16 |
| 6,627,784 | B2 * | 9/2003 | Hudson et al. | ..... | 588/320 |
| 6,632,327 | B1 * | 10/2003 | Shall | ..... | 162/29 |
| 7,105,039 | B2 * | 9/2006 | Decker | ..... | 95/187 |

FOREIGN PATENT DOCUMENTS

| | | |
|---|---|---|
| JP | S62-276095 | 11/1987 |
| JP | S08-173979 | 7/1996 |
| WO | WO 98/54400 | 12/1998 |
| WO | WO 01/87471 A2 | 11/2001 |

* cited by examiner

*Primary Examiner*—Peter A Hruskoci
(74) *Attorney, Agent, or Firm*—Manabu Kanesaka

(57) ABSTRACT

Lignin and alkali are efficiently sorted out of alkaline black liquor discharged from the paper manufacturing/pulp and paper manufacturing industries and the treated water is made as purified water.

Acid is added to the black liquor and its pH is adjusted to 2.5 to 3.5. An aggregating agent is added to have lignin contained in the black liquor settled and the black liquor is separated into lignin and clean water. Ozone gas, preferably in the micro bubble state, is given to the clean water for contact reaction.

4 Claims, 3 Drawing Sheets

BLACK LIQUOR TREATMENT METHOD

TECHNICAL FIELD

In treatment of black liquor discharged from paper manufacturing/pulp and paper manufacturing industries, the black liquor contains lots of harmful properties. Thus, a large amount of investment is made in equipment for the measures to recover alkaline and to concentrate the black liquor, and incineration processing is carried out including energy use. But it takes a large amount of cost and discharge of air polluting and malodorous substances into the air. The present invention relates to offering of a method for treating this black liquor.

BACKGROUND ART

The black liquor is discharged from a pulping (removal of lignin) process of wood substances. The origin of the black liquor is pulping liquor, and since the pulping liquor uses sodium hydroxide to dissolve lignin in water and further uses sodium sulfide to promote removal of lignin, the black liquor is a harmful alkaline liquid substance containing hydrogen sulfide, methyl mercaptan, dimethyl sulfide, and dimethyl disulfide generated by hydrolysis of sodium sulfide as well as carbohydrates, organic acids and resins other than lignin.

In a conventional black liquor treatment method, this liquid substance is concentrated using a large-scale multi-effect vacuum evaporator method to increase the concentration of a solid portion, and the concentration is further increased by oxidization by air, sodium sulfide and an effluent of sulfate salt are added to this black liquor and then burned. After that, sodium carbonate, sodium sulfide, which are inorganic chemicals, are recovered from the ash, and burning energy is used for water feed heating of a boiler, but much of it is discharged to the air.

And the sodium carbonate is dissolved in water, calcium hydroxide is converted to sodium hydroxide, and the sodium hydroxide is used as the pulping liquor again to promote recycling.

However, the equipment cost of the measures in the conventional art is large, malodorous substances leak to the outside of the facilities, and a large quantity of water is used. And since most of lignin is burned and discharged to the air as an exhaust gas, required treatment costs are extremely large.

The unique odor felt in the vicinity of plants for paper manufacturing/pulp and paper manufacturing in our country is caused by sulfur compounds such as dimethyl sulfide. Since a large quantity of water is used, it is discharged after use and emission of exhaust gas is extremely large, there is a demand for black liquor treatment in a method friendly to the environment.

DISCLOSURE OF INVENTION

The present invention is to solve the above problems and is a treatment method of black liquor constituted as below.

(1) A black liquor treatment method characterized in that, after alkaline black liquor discharged from paper manufacturing/pulp and paper manufacturing industries is diluted with water and then, acid is added to the liquor and its pH is adjusted to 2.5 to 3.5. Then, a slight amount of an aggregating agent is added to solidify lignin contained in the black liquor to be settled, or settled and floated so that it is separated into a solid substance of lignin and clean water.

In this case, the types of acid to be added are hydrochloric acid, sulfuric acid, nitric acid, formic acid, fluorinated acid and the like, and most of lignin contained in the black liquor is settled by this treatment and lignin can be easily separated.

(2) A black liquor treatment method, wherein ozone gas is brought into contact with the clean water for reaction described in the above (1) and one or two or more components selected from unsettled lignin contained in the clean water, organic acids and resins contained in wood substances, soluble carbohydrate substances contained in hemi-cellulose or other sulfur compounds are oxidatively decomposed by oxidizing power of ozone.

(3) A black liquor treatment method, wherein, after sand filtration of the clean water, contact reaction of the ozone gas described in the above (2) is carried out.

(4) A black liquor treatment method, wherein ozone gas is supplied to the clean water described in any one of the above (1) to (3) as micro bubbles for contact reaction.

(5) A black liquor treatment method, wherein in a process of contact reaction of the ozone gas with the clean water described in any one of the above (2) to (4), first, the ozone gas is mixed with a part of the clean water in a high-speed stirrer to have a micro bubble mixed liquor of the ozone gas and the micro bubble mixed liquor is discharged into the clean water.

The clean water after solid-liquid separation or the like contains lignin, soluble carbohydrate substances contained in hemi-cellulose, organic acids in wood substances and their neutralizers, resins contained in the wood substances and their saponified substances, tall oil, dimethyl sulfide, hydrogen sulfide, methyl mercaptan, dimethyl disulfide and the like, and strong oxidant is required for decomposition of these organic substances. The present invention solves the problem.

The ozone gas, which is a strong oxidant, is currently made by an ozone generator, but nearly 90% of it contains $O_2$, $N_2$, $CO_2$ and the like with about 10% being $O_3$. Therefore, in order to make use of the oxidizing power of this $O_3$ as much as possible, conditions to facilitate promotion of oxidative decomposition by $O_3$ are needed. Since when pH of the black liquor is lowered to about pH3 by acid, the oxidizing power of this $O_3$ is increased, that is, the smaller the bubble of $O_3$ gas is, the larger the reaction surface becomes, which means drastic increase of the oxidizing power.

In order to reduce the size of a particle of $O_3$ gas bubble to the micro level, the clean water and $O_3$ is mixed at a high speed, for example, it became possible to make the size of the $O_3$ gas bubble extremely small. This small bubble is destroyed/extinguished by the time when it reaches the clean water level, but at the instant of this destruction/extinction, the internal temperature of the bubble is said to become as high as several thousands degrees and the pressure being as high as several thousands atmospheres. It is preferable to treat the $O_3$ gas in the micro-level bubble state after pH adjustment by addition of acid. At this time, it is preferably irradiated with an ultrasonic wave at the same time, since the destruction/extinction action is promoted.

(6) A black liquor treatment method, wherein a high-speed stirrer described in the above (5) is made of stainless material and in a structure that the clean water is introduced into an impeller type stirrer rotating at a high speed of 3000 to 20000 rotations per minute and ozone is blown into, in which the clean water and ozone are mixed in the stirrer, ozone at this time is to become a micro bubble and a mixture of the micro bubble and the clean water are discharged into the clean water reserved in a reaction tank from below and reserved in the clean water for a long time.

(7) A black liquor treatment method, wherein the clean water obtained in the above (1) or the clean water liquor given oxidative treatment with ozone obtained in any one of the above (2) to (6) is used as diluting water for the black liquor or water for pulp and paper manufacturing.

(8) A black liquor treatment method, wherein the clean water to which contact reaction of ozone gas described in any one of the above (2) to (6) is applied is neutralized and then, adsorption treatment is given by bringing it into contact with active carbon.

The organic acids contained in the clean water are completely decomposed to $CO_2$ and $H_2O$, and finally, impurities can be adsorbed and removed by the active carbon to obtain purified water. The obtained purified water (clean water) can be also used for dilution and as water for pulp and paper manufacturing.

In this way, according to the present invention, removal (separation) of lignin in the black liquor is easily achieved by making the dissolved lignin into suspended solids (SS) by pH adjustment.

And it is possible at a normal temperature and a normal pressure, and an electric utility charge involved with use of $O_3$ can be considerably reduced by effects of acid and micro bubbles.

Generally speaking, the oxidative decomposing power of ozone ($O_3$) is based on the oxidizing power of an oxygen atom in ozone. pH in the black liquor is lowered to about 3 by addition of acid so as to bond a hydrogen atom in the acid with ozone atom and an active oxygen having a oxidizing power stronger than the oxygen atom is generated. The oxidizing power of this active oxygen has a decomposing power far exceeding the oxidizing power of the oxygen atom, and the decomposing power is remarkably improved by adding acid to the clean water of a substance to be treated to brig it to about pH 3 and by adding ozone.

DESCRIPTION OF REFERENCE NUMERALS

Figure 1:
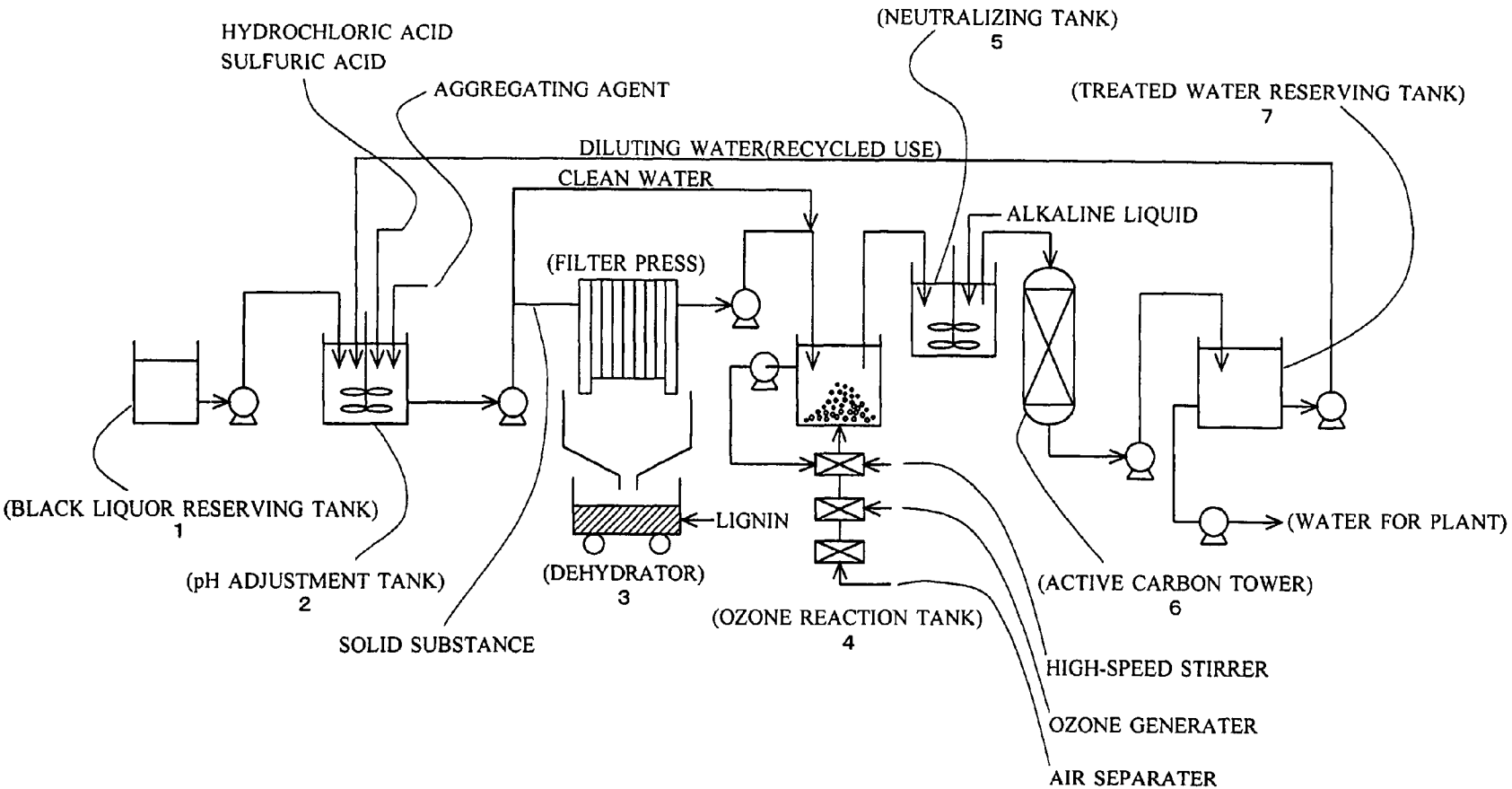
FIG. 1 is a system diagram of an embodiment of the present invention.

1: Black liquor reserving tank
2: pH adjustment tank
3: Dehydrator
4: Ozone reaction tank
5: Neutralizing tank
6: Active carbon tower
7: Treated water reserving tank

BEST MODE FOR CARRYING OUT THE INVENTION

An embodiment of the present invention will be described based on an example.

Embodiment 1

Figure 2:
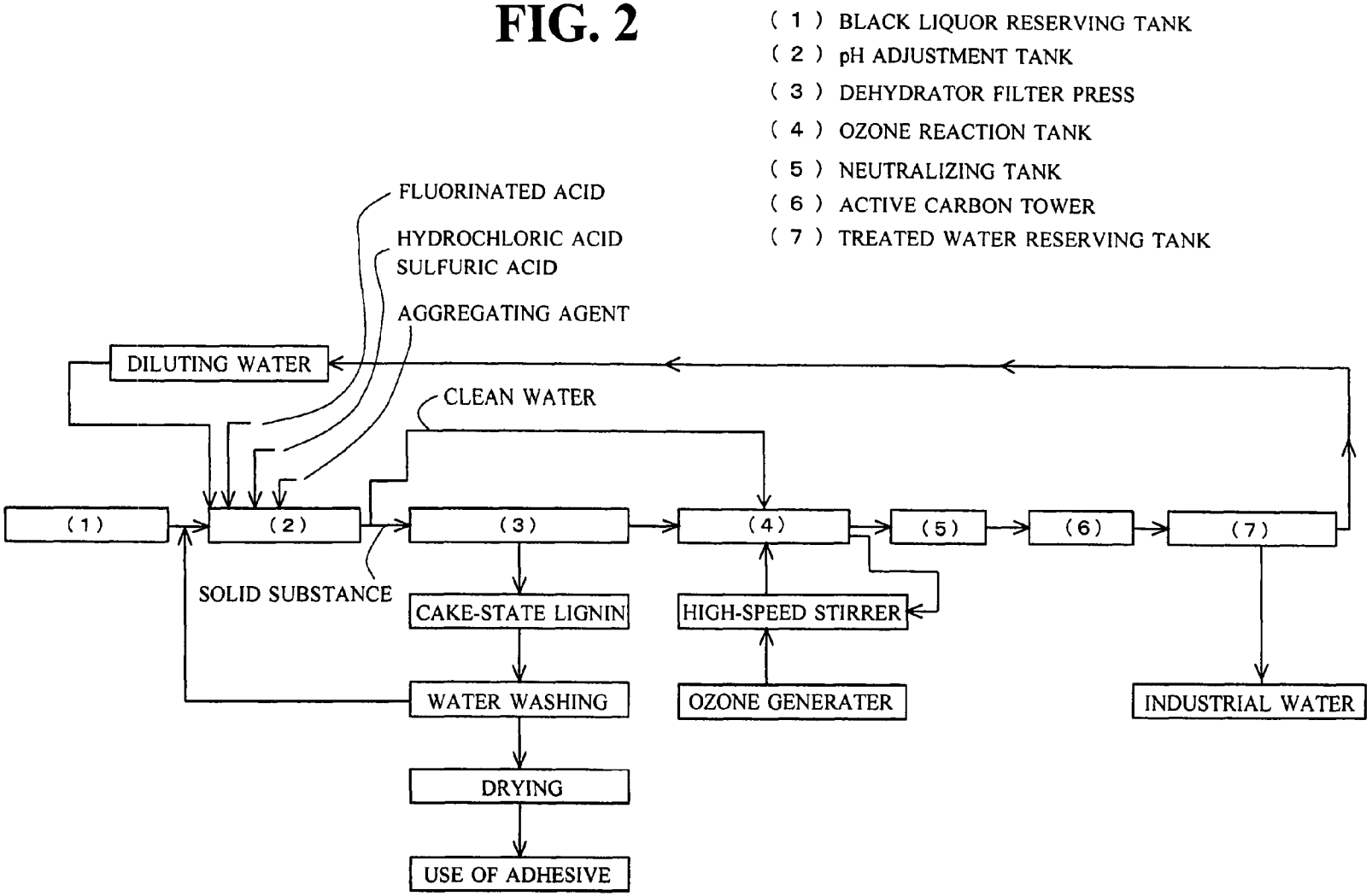
FIG. 2 is a flowchart of the embodiment of the present invention.

FIG. 1 shows a system diagram of the embodiment and FIG. 2 shows its flowchart.

First, in FIG. 1, black liquor is reserved in a reserving tank 1 from the left.

Then, the black liquor and diluting water is put in a pH adjustment tank 2, and by adding acids such as hydrochloric acid, sulfuric acid and the like as well as an aggregating agent and by gently stirring, lignin and the others are settled. At this time, it is preferable to add a slight amount of fluorinated acid as an acid.

Then, in a dehydrator 3, lignin is sorted out as a solid substance by filter press, for example.

The liquid from which lignin was removed by filter press is introduced into an ozone reaction tank 4 for contact reaction with ozone as micro bubbles.

At this stage, ozone gas, which is a strong oxidizing substance, has its oxidizing power maximized, and the smaller the $O_3$ gas bubble is, the larger the reaction surface becomes, and the oxidizing power is remarkably increased.

In order to reduce the size of a particle of the $O_3$ gas bubble to a micro level, the clean water and $O_3$ are stirred at a high speed. Then, the size of the $O_3$ gas bubble can be extremely reduced to a small bubble and at the instance when this bubble disappears, the internal temperature of the bubble is said to reach as high as several thousands degrees and the pressure being as high as several thousands atmospheres, and the reaction progresses strongly.

Next, in a neutralizing tank 5, an alkaline liquid is added for neutralization and then, it is introduced into an active carbon tower 6, where all the impurities are adsorbed and removed to have purified treated water.

The treated water is reserved in a treated water reserving tank 8 and introduced into a pH adjustment tank 2 to be used as (1) diluting water or (2) other industrial water.

In the flowchart in FIG. 2, more specific description is made with letters.

Example 2

Figure 3:
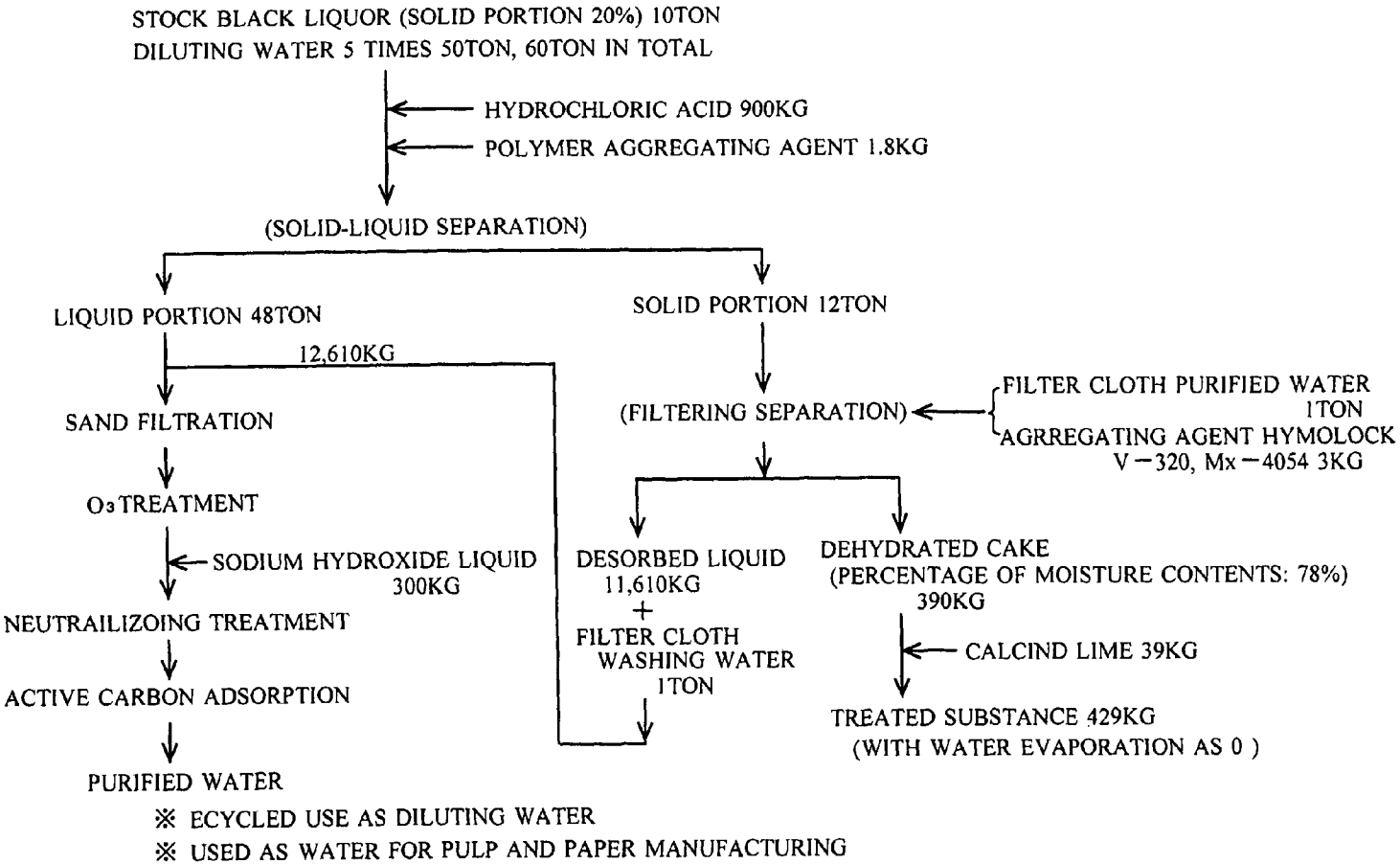
FIG. 3 is a flow chart of the embodiment of the present invention.

The black liquor was treated according to the flowchart shown in FIG. 3.

First, 50 t of diluting water is added to 10 t of black liquor stock solution (containing 20% of solid portion) to have 60 t of liquor to be treated in total. 900 kg of hydrochloric acid is added and 1.8 kg of polymer aggregating agent is further added while stirring. And then, it is left as it is so that a liquid portion and a solid portion are separated.

The obtained 48 t liquor portion is sand-filtered, and ozone gas in the micro bubble state is introduced into the filtered water obtained by sand filtration for oxidization treatment and then, 300 kg of sodium hydroxide is added for neutralization treatment. Then, the neutralized water is passed through an active carbon column for adsorption treatment of impurities to obtain purified water.

This purified water is used as the above diluting water or water for pulp and paper manufacturing.

On the other hand, 12 t of the solid portion obtained in the above liquid-solid separation process is put through filter press for filtering and separated to 11,610 kg of desorbed liquor and 390 kg of dehydrated cake (percentage of moisture contents: 78%). At filtering separation, it of filter fabric washing water and 3 kg of aggregating agent are used.

The desorbed liquor and the filter fabric washing water are added to the liquid portion before sand filtration.

Also, 39 kg of calcined lime is added to and mixed with the above dehydrated cake to obtain 429 kg of treated substance in the dry and coarse particle state. This treated substance contains lots of lignin and is a composition easy to be handled and not water-soluble.

Table 1 shows analytic values of the stock black liquor and the treated liquor in each process.

As is seen from the numeral values in the table, the water quality of the finally obtained treated water (purified water)

has excellent values all in BOD, COD, SS and the like, and it was found out that the water is purified water with excellent water quality.

TABLE 1

| |
|---|
| Subject, A, B |
| Item |
| Stock sample (Stock black liquor) |
| Sand filtration (inlet) |
| Sand filtration (outlet) |
| $O_3$ reaction tower (inlet) |
| $O_3$ reaction tower (outlet) |
| SS, 10 or less, 10 or less |
| Active carbon adsorption (inlet) |
| SS, 10 or less, 10 or less |
| Active carbon adsorption (outlet) |
| SS, 10 or less, 10 or less |
| Treated water quality (purified water) |
| SS, 10 or less, 10 or less |
| Unit BOD, COD are mg/L, SS is mg/kg. |
| Industrial Applicability |

The present invention can be employed as an effective treating method for black liquor containing lignin in the paper manufacturing, pulp and paper manufacturing fields.

According to the present invention, lignin and alkali can be efficiently sorted out of the black liquor, and the treated water can be utilized for various applications including diluting water for the black liquor, water for pulp and paper manufacturing and so on.

The invention claimed is:

1. A black liquor treatment method, comprising:

diluting alkaline black liquor discharged from paper pulping operation with water, adding acid to the liquor so as to adjust pH in a range from 2.5 to 3.5, adding an aggregating agent to solidify lignin contained in the black liquor to be settled, or settled and floated, so as to separate a solid substance of lignin and clean water, filtering the clean water, and contacting ozone gas with the clean water in a reaction tank so as to oxidatively decompose at least one component selected from the group consisting of unsettled lignin contained in the clean water, organic acids and resins contained in wood substances, soluble carbohydrate substances contained in hemi-cellulose, and sulfur compounds, wherein the ozone gas is blown into a part of the clean water and stirred by a stirrer so as to form a micro bubble mixed water of the ozone gas, and the micro bubble mixed water is discharged into the clean water, the stirrer is made of stainless material, and comprises an impeller type stirrer rotating at a speed of 3000 to 20000 rotations per minute into which the part of the clean water is introduced and the ozone gas is blown, thereby mixing the clean water and the ozone gas with the stirrer so that the ozone gas becomes the micro bubble, and a mixture of the micro bubble and the clean water is discharged into the clean water in said reaction tank from below so that the micro bubble remains in the clean water for an effective time to decompose said component.

2. A black liquor treatment method according to claim 1, wherein the clean water or the clean water containing ozone is used as diluting water for the black liquor or water for the paper pulping operation.

3. A black liquor treatment method according to claim 1, wherein the clean water containing ozone is neutralized, and adsorption treatment is subsequently conducted by contacting the clean water with active carbon.

4. A black liquor treatment method according to claim 1, wherein the clean water is irradiated with an ultrasonic wave during the contacting step.

* * * * *